United States Patent [19]

Peterson et al.

[11] 3,942,010

[45] Mar. 2, 1976

[54] JOULE-THOMSON CRYOSTAT COOLED INFRARED CELL HAVING A BUILT-IN THERMOSTAT SENSING ELEMENT

[75] Inventors: Eugene W. Peterson; Howard P. Wurtz, Jr., both of Santa Barbara; Marvin R. Winner, Goleta, all of Calif.

[73] Assignee: The United States of America as represented by the Secretary of the Navy, Washington, D.C.

[22] Filed: May 9, 1966

[21] Appl. No.: 548,797

[52] U.S. Cl. ..... 250/352; 250/338; 250/370

[51] Int. Cl.[2] ..... G01J 1/00

[58] Field of Search..... 250/370, 352, 338

[56] References Cited

UNITED STATES PATENTS

| | | | |
|---|---|---|---|
| 3,103,585 | 9/1963 | Johnson et al. | 250/352 |
| 3,114,041 | 12/1963 | Amsterdam | 250/352 |

*Primary Examiner*—Maynard R. Wilbur
*Assistant Examiner*—S. C. Buczinski
*Attorney, Agent, or Firm*—Richard S. Sciascia; Ervin F. Johnston; Thomas Glenn Keough

[57] ABSTRACT

A cryogenically cooled infra-red detection cell assembly comprises a Dewar-flask type of thermal insulation casing. The closed end of the Dewar casing is the front end of the assembly and is adapted to have a lead sulfide infra-red transducer mounted on the inside face of the casing inner end wall, and to have the casing outer end wall form a part of a lens system for focusing on the transducer. A Joule-Thomson cryostat projects into the casing so as to maintain liquid nitrogen adjacent the outside face of the inner end wall. A mass of absorbent packing is placed in the Dewar casing adjacent its closed end, just ahead of the cold end of the cryostat to retain the liquid nitrogen there. The cold end of the cryostat is mounted to a metal mandrel, with the rear end of the mandrel serving as a mount for a small piece of gold-doped germanium. This piece of doped germanium acts as a variable resistance at the critical range of temperature control for the front end of the cryostat, and is operatively connected to a thermostat circuit which actuates the valve controlling the flow of gas into the cryostat. The electrical connections to the lead sulfide transducer consist of conductive strips which extend rearwardly along the inside surface of the inner lateral wall of the Dewar casing. Shieldings to prevent microphonics due to casing vibration, and microphonics due to gas motion in the cryostat, are deposited on the surfaces of the lateral walls of the Dewar casing.

5 Claims, 4 Drawing Figures

INVENTORS.
EUGENE W. PETERSON
HOWARD P. WURTZ, JR.
MARVIN R. WINNER
BY
MICHAEL F. OGLO
ROY MILLER
ATTORNEYS.

INVENTORS.
EUGENE W. PETERSON
HOWARD P. WURTZ, JR.
MARVIN R. WINNER
BY
MICHAEL F. OGLO
ROY MILLER
ATTORNEYS.

JOULE-THOMSON CRYOSTAT COOLED INFRARED CELL HAVING A BUILT-IN THERMOSTAT SENSING ELEMENT

This invention relates to improvements in infrared energy sensing units of the type having a transducer cell that operates at cryogenic temperatures, under the cooling action of a Joule-Thomson cryostat. More particularly it refers to such a unit having a built-in temperature senser to provide thermostatic control of the cryostat.

An object of the invention is to provide an infrared energy sensing unit having a built-in temperature senser which is effective in providing thermostatic control over a cryogenic temperature range including that of liquid nitrogen.

Another object is to provide a unit in accordance with the previous objective, and which further provides effective shielding of the infrared signal channel from microphonic noise due to vibration and movement of refrigerant.

Other objects, advantages and novel features of the invention will become apparent from the following detailed description of the invention when considered in conjunction with the accompanying drawings wherein.

Figure 1:
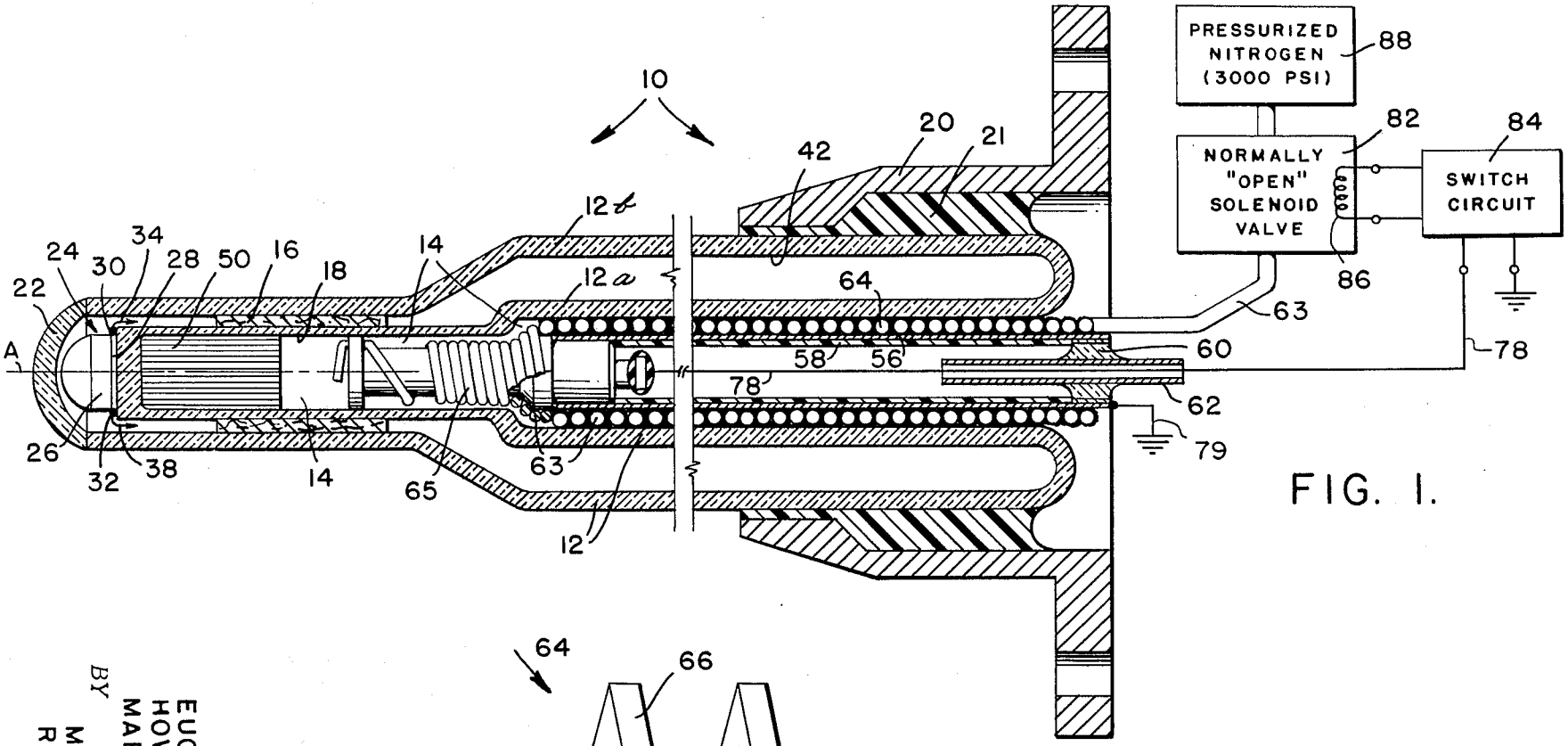
FIG. 1 is a central section through an infrared sensing unit in accordance with this invention, with certain portions being shown in side elevation, and also showing a block diagram of associated refrigerant gas control system components.

Referring now to the drawing, and in particular to FIG. 1, the subject of the invention is a unit 10 consisting of a combined infrared energy sensor and a cryogenic cooling mechanism adapted for thermostatic control. Unit 10 has a Dewar flask type glass casing 12 comprising an inner wall 12*a* and outer wall 12*b* with evacuated space therebetween. Casing 12 forms an elongated cryostat chamber or well 14, and serves as unit 10's frontal and lateral outer thermal insulation wall. Casing 12 is of a generally cylindrical shape about axis A. The majority of its length, starting from the rear end is of uniform diameter. Near the front end, the diameter of casing 12 is necked down to a reduced uniform diameter which extends forwardly to the front end. A corresponding necking down of the internal diameter of the cryostat well 14 also takes place. An annular packing element 16 of excelsior-like thermal insulation material is disposed between the inner and outer walls of casing 12 in its reduced diameter portion to prevent undesired vibrational motion between these walls. A conductive layer 18, best shown in FIG. 2, of lead sulphide (PbS) having a thickness in the range 0.0006 – 0.0010 inches is applied to the exterior (radially innermost) surface of inner wall 12*a*. This layer may be built up by conventional techniques of forming PbS films by means of chemical reaction. Layer 18 is coupled to ground through a suitable electrical lead connection to a circuit ground point 19, shown symbolically. The Dewar casing is mounted within a metallic shell 20, and is bondingly held in integral relation therewith by a potting material 21.

Figure 2:
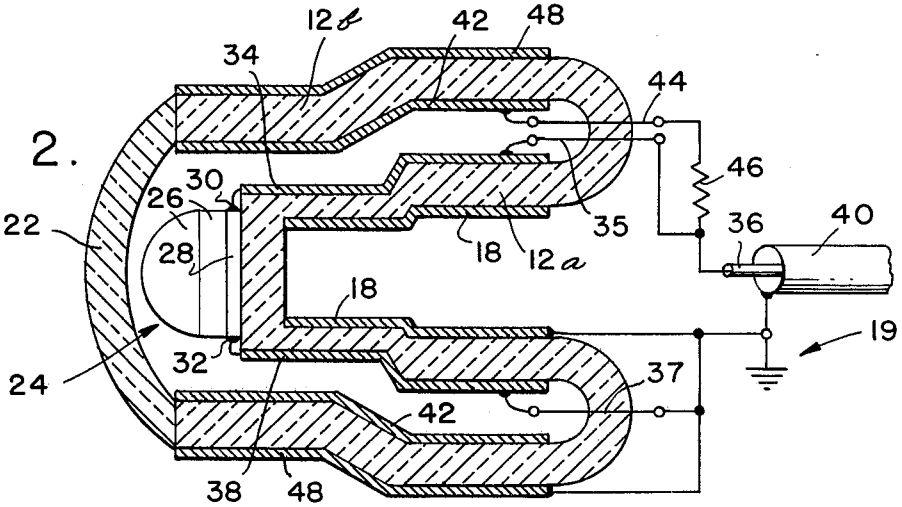
FIG. 2 is a diagrammatic representation of a central section of the glass casing, showing coatings and layers applied to the glass surface with exaggerated thickness, also showing a wiring diagram of elements associated with the coatings.

Referring now to FIGS. 1 and 2, the front end of the Dewar casing 12 has its outer wall formed by a conventional synthetic sapphire window and outer lens element 22 hermetically bonded to the edges of glass lateral walls of the casing. The frontal surface of the inner Dewar casing wall 12*a* is shaped as a flat transverse surface, and a conventional inner lens and lead sulphide sensor cell 24 is cemented thereto. Unit 24 comprises a forwardly convex lens element 26 made of strontium titanate, and an interfingered lead sulfide strip type infrared energy-electrical signal transducer or sensor cell 28, shown edgewise in the drawing and with exaggerated thickness, is bonded to the rear face of lens element 26, between the latter and the flat frontal surface of the inner Dewar casing wall. Window and outer lens element 22, and inner lens element 26, form a lens system for providing a desired directive response to infrared energy within an optical cone having a predetermined included angle and aligned about axis A. A typical value for the included angle of the optical cone is 35°. The electrical output of the sensor cell appears across a pair of electrodes 30 and 32. Forming the electrical coupling from electrode 30 is a connection 34, of conventional construction, consisting of a narrow rearwardly extending strip of deposited metal, or of conductive paint applied to the interior (radially outermost) surface of inner Dewar casing wall 12*a*. Electrical connection 34 is illustrated diagrammatically as an arrow in FIG. 1, and is diagrammatically shown as a layer in the cross section of FIG. 2. The rear end of connection 34 is coupled to a conventional hermetically sealed pin 35 which passes through the glass wall. The outer end of pin 35 is connected to the wire 36 forming the infrared output channel of unit 10. Another similar electrical connection 38 communicates electrode 32 to a pin 37, and thence to a circuit ground point 19, and in turn to a shielding 40 about the infrared output signal channel wire 36.

Electrical lead connections 34 and 38 are conductive strips which physically extend the entire length of the casing, and they are therefore susceptible to the picking-up of microphonic noise due to the change of capacitance between strips 34 and 38 under vibration of the casing. The lateral expanse of the interior surface of outer wall 12*b* is coated with a gold film 42, FIG. 2. A hermetically sealed pin 44 extends through the wall at the rear end of casing 12 and communicates film 42 to one end of an isolation resistor 46. The other end of the resistor is connected to the infrared output signal channel wire 36. A typical value for isolator resistor 46 is 18K ohms. The connection of the gold film 42 to the output signal wire through the isolation resistor effectively maintains a zero charge across the capacitance between strips 34 and 38, and thus prevents generation of the aforesaid microphonic noises. A layer 48 of silver paint is applied to the lateral expanse of the exterior surface of outer wall 12*b*, and is coupled to the electrical lead connection to ground 20. Silver layer 48 provides a large capacitative coupling between gold film 42 and ground, which effectively shields gold film 42 from stray electromagnetic radiation which would otherwise tend to be fed into the infrared signal channel through resistor 46.

Figure 4:
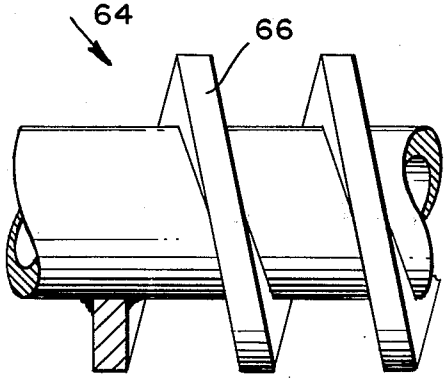
FIG. 4 is an enlargement of a detail of FIG. 1.
Figure 3:
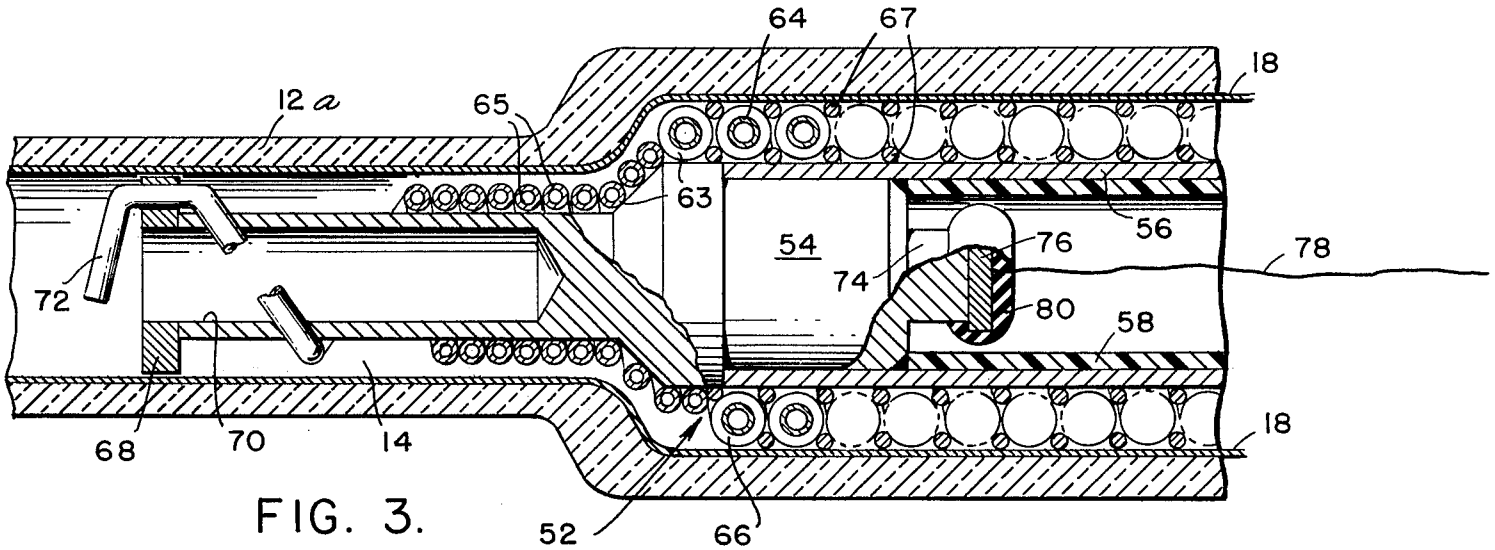
FIG. 3 is an enlargement of a portion of FIG. 1.

A packing 50 of a liquid absorptive material such as rolled blotter paper is disposed in the extreme forward end of cryostat well 14, in abutting relation against the rear surface of frontal portion of inner wall 12*a* of the Dewar casing. An elongated Joule-Thomson cryostat assembly 52, best shown in FIG. 3, is disposed in cryostat well 14 with its forward tip in spaced relation to the absorptive packing 50. Cryostat assembly 52 comprises a two-piece mandrel consisting of a forward end heat exchange tip 54 made of brass or a hard copper, and a rear tubular member 56 made of stainless steel which telescopically engages a portion of heat exchange tip 54. Tubular member 56 also has an inner wall 58 made of Teflon and a closure 60, FIG. 1, at its rear end, including a centrally supported electrical wire conduit tube 62. A refrigerant gas line 63, comprising a portion of finned tubing 64 and a front portion made of plain tubing 65, is wrapped in a tight helix around the periphery of tubular member 56 and heat exchange tip 54. The finned tubing, best shown in the enlarged view of FIG. 4, has a metal helical fin 66 extending along its length to increase its heat transfer area. The finned tubing 64 extends from the rear to front end of tubular member 56 where it joins the plain tubing 65, which extends about the tip of member 54. The outer diameter of tubular member 56, the overall diameter of tubing including its helical fin, and the inside diameter of the coating on the walls of the cryostat wall, are such that cryostat assembly 52 is retained in the cryostat well with the outer periphery of the tubing fins in a "soft" force fit relationship to the PbS coating which it engages. If desired, cord material 67 may be wrapped in the spaces between the coiled supply tubing to increase the snugness of the fit. The PbS coating serves to shield the conductive infrared signal connections strips 34 and 38 from microphonic and electrostatic noises caused by the motion of nitrogen through the cryostat tubing. As will be hereinafter explained in greater detail, the nitrogen is in a liquified state during its passage through the tubing, shortly after the start of cryostat operation.

As best shown in FIG. 3, the front end of the heat exchange tip 54 terminates in a collar portion 68 having an outer diameter slightly undersized relative inner diameter of the coated cryostat well 14. An axial, blind bore 70 extends into the body of heat exchange tip 54 from its front end face, increasing the heat exchange surface on the front side of this element. The forward terminal end of the gas supply tubing extends through an aperture in collar portion 68, and is bent radially inwardly with the open end 72 of the tube adjacent to the opening of blind bore 70. This end of the tube serves as the nozzle to produce the Joule-Thomson cooling effect, and locating it adjacent the heat exchange tip bore 70 insures that the interior of the bore will be a very cold zone. The heat exchange tip 54 forms a closure at the front end of the tubular mandrel member 56. Thus, the only path for exhausting the gases which are introduced into the forward end of cryostat well 14 is back through the annular space between the mandrel and the wall of the cryostat well in which the coiled tubing 64 is disposed. This counter flow of exhaust gases across the finned tubing regeneratively cools the gas supply in its forward flow through the tubing, causing it to liquify within the tubing and to emerge from the open end 72 of tubing 64 as liquid nitrogen after a short interval of cryostat operation.

A small boss 74 is formed on the rear end face of heat exchange tip 54. Affixed to boss 74 is a varistor element 76 made of gold impurity doped germanium having the following characteristics:

| | |
|---|---|
| Gold Concentration | $1.5 \pm 0.3 \times 10^{15}$ Atoms/CC |
| Dopant | 99.999% Gold Min |
| Conductivity | "P" Type |
| Crystal Orientation | (111) |
| Resistivity | $2.3 \pm 0.5$ Ohms/CM at 20° C. |
| Growth Process | Zone Belt |

Element 76 is cut to provide predetermined resistance between its front and rear faces at a given temperature, and is mounted to boss 74 with its front face in electrical contact therewith. An electrical lead wire 78 is electrically coupled to the rear face of the varister element 76, and extends through conduit tube 62 at the rear end of tubular member. The front side of the varistor element is coupled to circuit ground through a ground return path consisting of heat exchange tip 54, tubular member 56, and a ground return connection 79. The varistor element and the point where lead wire 78 joins it are encapsulated in silicone rubber potting 80.

It has been found that the above formulation of varistor material exhibits a negative temperature coefficient of resistance in the cryogenic temperature region near the temperatures of liquid nitrogen. The varistor element forms the temperature sensor for a thermostatic control system comprising a normally opened solenoid valve 82, and an impedance responsive electronic switch circuit 84. When the magnitude of impedance between lead wire 78 and ground exceeds a predetermined "turn on" threshold value, circuit 84 is actuated to its "on" condition, thereby causing winding 86 to be energized. Circuit 84 has a "turn off" threshold value which is somewhat below the turn on value, and when the magnitude of impedance between lead 78 and ground drops below this turn off value, circuit 84 is actuated back to its "off" condition, de-energizing winding 86. One example of circuit 82, found to provide highly satisfactory results, is that disclosed in the copending application of Walter E. Frietag entitled, "Improved Switching Circuit of a type Employing a Four-Layer Solid State Switching Device," filed concurrently herewith. In operation, the refrigerant gas from a pressurized source 88 flows through the normally open solenoid valve into the coiled refrigerant gas line 63 of cryostat assembly 52. Expansion of the gas as it emerges from the opened front end 72 of the tubing cools the foreward end of the cryostat, which in turn cools the infrared energy sensing cell on the front face of wall 12*a* to its desirable cryogenic temperature of operation. A preferred mode of operation is to employ a supply of nitrogen gas pressurized to 3000 psi and to otherwise choose the components to cool the front end of the cryostat well 14 to the point that nitrogen emerging from open end 72 of the tubing condenses and forms a liquid pool of nitrogen, which is retained by the absorbent packing 50. The turn on threshold of switch circuit 84 is chosen to cause energization of the winding 86, of solenoid valve 82, when the varistor temperature is lowered to the temperature of liquid nitrogen, indicating a pool has been formed. Energizing the winding of the normally open solenoid valve interrupts the flow of refrigerant gas to the cryostat. The turn off threshold of circuit 84 is so chosen to cause the winding of the solenoid valve to be de-energized when the front end of the cryostat has warmed to the point at which the nitrogen pool outside the blotter has evaporated, and gas again flows through the cryostat. Since gas is turned on only to maintain the desired temperature, unit 10 yields economy of gas consumption.

Obviously many modifications and variations of the present invention are possible in the light of the above teachings. It is therefore to be understood that within the scope of the appended claims the invention may be practiced otherwise than as specifically described.

What is claimed is:

1. A cryogenic infrared energy sensing unit having a built-in Joule-Thomson cryogenic cooler of the type utilizing exhaust refrigerant gas to regeneratively cool the refrigerant supply line and having a built-in thermostat sensing element for providing an electrical signal to control operation of the cooler, in combination, comprising, a. a double walled, Dewar type thermal insulation casing having a closed and an open end, the interior of the casing forming an elongated central cryostat chamber, the closed end of the thermal insulation casing forming the front end of the unit and containing an infrared sensor element affixed to the interior surface of the inner wall of the double walled casing, the outer wall of the casing at the front end being formed of an infrared energy window material, b. a cryostat assembly shaped for insertion in the cryostat chamber and adapted to cool the exterior surface of the inner wall of the double walled casing at the front end, said cryostat assembly comprising a two-piece mandrel consisting of a rear thin walled tubular member and metallic heat exchange front end tip member plugging the front end of the tabular member, and a refrigerant supply tube helically wrapped around the two-piece mandrel terminating at its forward direction with an open end to form the gas expansion nozzle to provide the Joule-Thomson cooling effect, the construction being such that the helically coiled refrigerant is supported between the tubular member of the two-piece mandrel and the wall of the cryostat chamber in a manner permitting counterflow of the exhaust gases from the front to rear end of the cryostat chamber about the helical tubing in the annular space between the mandrel and the lateral wall of the cryostat chamber, c. a temperature responsive variable impedance element made of an impurity doped semi-conductor material which intrinsically exhibits temperature sensitive characteristics at the cryogenic temperature region desired for operation of the infrared sensor element, said variable impedance element being disposed in the interior of the tubular mandrel element and affixed by one of its sides to rear face of the heat exchange front end tip member, and d. means forming a pair of output connections across the variable impedance element and accessible from the exterior of the unit.

2. Apparatus in accordance with claim 1, wherein e. said heat exchange front end tip member being shaped as a cylindrical of revolution about the cryostat chamber axis and having a blind axial bore formed therein and opening from the front end of the tip member, f. the forward terminous of said refrigerant supply tube being disposed adjacent the opening of said blind axial bore.

3. Apparatus in accordance with claim 1, wherein;

g. said refrigerant supply tube having a spirally extending radial fin thereabout for the portion thereof wrapped around the tubular member of the two-piece mandrel.

4. Apparatus in accordance with claim 1, wherein h. said variable impedance element is made of gold doped germanium material.

5. Apparatus in accordance with claim 4, i. the gold doped germanium material further having approximately the following characteristics of composition:

| | |
|---|---|
| Gold Concentration | $1.5 \pm 0.3 \times 10^{15}$ Atoms/CC |
| Dopant | 99.999% Gold Min |
| Conductivity | "P" Type |
| Crystal Orientation | (111). |

* * * * *